US006636719B2

(12) United States Patent
Kunishi et al.

(10) Patent No.: US 6,636,719 B2
(45) Date of Patent: Oct. 21, 2003

(54) IMAGE FORMING APPARATUS WITH VIBRATION-CAUSED IMAGE DEFECT PREVENTION FEATURE

(75) Inventors: Tsuyoshi Kunishi, Ibaraki-ken (JP); Jun Asai, Nagareyama (JP); Keizo Ogara, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/207,846

(22) Filed: Jul. 31, 2002

(65) Prior Publication Data

US 2003/0031488 A1 Feb. 13, 2003

(30) Foreign Application Priority Data

Jul. 31, 2001 (JP) ..... 2001-232779

(51) Int. Cl.[7] ..... G03G 21/00
(52) U.S. Cl. ..... 399/343; 399/350
(58) Field of Search ..... 399/34, 123, 343, 399/350, 351, 98, 99, 358, 127

(56) References Cited

U.S. PATENT DOCUMENTS 6,128,461 A 10/2000 Yoshikawa ..... 399/350

FOREIGN PATENT DOCUMENTS

| | | |
|---|---|---|
| JP | 6-4014 | 1/1994 |
| JP | 9-160455 | 6/1997 |
| JP | 11-174922 | 7/1999 |

*Primary Examiner*—Sophia S. Chen
*Assistant Examiner*—Ryan Gleitz
(74) *Attorney, Agent, or Firm*—Fitzpatrick, Cella, Harper & Scinto

(57) ABSTRACT

An image forming apparatus includes an image bearing member; a driver for driving the image bearing member; a latent image forming device for forming an electrostatic latent image on the image bearing member; a developing device for developing the electrostatic latent image on the image bearing member with a developer; a cleaning member, contacted to the image bearing member, for cleaning a surface of the image bearing member; a vibration imparting device for vibrating the cleaning member; and a controller for causing the latent image forming means to form an electrostatic pattern for attracting the developer deposited on the cleaning member and for causing the device to move the electrostatic pattern to a contact portion where the cleaning member is contacted to the image bearing member.

12 Claims, 8 Drawing Sheets

IMAGE FORMING APPARATUS WITH VIBRATION-CAUSED IMAGE DEFECT PREVENTION FEATURE

FIELD OF THE INVENTION AND RELATED ART

The present invention relates to an image forming apparatus such as a printer, a copying machine, a facsimileing machine, and the like which is provided with a cleaning apparatus for cleaning a surface of an image bearing member.

In the field of a cleaning apparatus for an image forming apparatus such as a printer, a copying machine, a facsimile machine, and the like, a cleaning apparatus having a cleaning blade as a cleaning member for cleaning an image bearing member has been known.

In an electrophotographic image forming apparatus, for example, a toner image is formed on a photoconductive drum (image bearing member) through a plurality of image forming processes: a charging process, an exposing process, and a developing process. The toner image is transferred onto a transfer medium (for example, recording paper, OHP sheet, or the like) from the photoconductive drum through a transferring process. During this transferring process, all the toner, of which the toner image on the photoconductive drum is formed, is not transferred; a small amount of the toner remains on the peripheral surface of the photoconductive drum. The toner remaining on the peripheral surface of the photoconductive drum (which hereinafter will be referred to as residual toner) is removed by the above described cleaning blade.

Referring to FIG. 9, the edge 61*a* of a cleaning blade 61 is placed in contact with the peripheral surface of a photoconductive drum 11, so that the residual toner adhering to the peripheral surface of the photoconductive drum 11 is scraped away by the cleaning blade 61.

However, the conventional cleaning apparatus having the cleaning blade 61 involves the following problems.

Also referring to FIG. 9, as the residual toner is scraped away by the edge 61*a* of the cleaning blade 61 placed In contact with the peripheral surface of the photoconductive drum 11, it agglomerates in the adjacencies of the edge 61*a*. Normally, as the agglomeration of the residual toner grows to a certain size, it falls off into the cleaning apparatus shell (unshown) of the cleaning apparatus, so as not to create a problem.

In recent years, however, it became evident that, due to the increase in the peripheral velocity (process speed) of the photoconductive drum 11 resulting from the increase in the speed of an image forming apparatus, the agglomeration of the toner kept on growing in size without falling, and that some of the toner particles slipped through the nip N (cleaning portion) between the edge 61*a* of the cleaning blade 61 and the photoconductive drum 11, and transferred onto a transfer medium (in the form of a sheet), forming stripes across the medium, during the following image formation cycle. The residual toner having slipped through the nip appears in the form of strips on the recording material in the next image forming operation.

As for a method for improving the cleaning performance of a cleaning blade, a few have been disclosed. For example, Japanese Laid-open Patent Applications 6-4014 and 11-174922 disclose a method which causes a cleaning blade to vibrate with the use of a piezoelectric element. This method, however, suffers from the following faults. That is, a piezoelectric element is attached to a cleaning blade, which deteriorates as its cumulative usage increases, and therefore, must be replaced. As the deteriorated cleaning blade is replaced with a fresh one, the piezoelectric element is replaced together with the deteriorated cleaning blade, resulting in cost increase, since the piezoelectric element is attached to the deteriorated cleaning blade. Further, it is difficult to vibrate sufficiently to remove the grown agglomeration of the residual toner. The Japanese Laid-open Patent Application 9-160455 discloses a method which uses impact to vibrate a cleaning blade. This method, however, suffers from the following problem: a certain behavior of a cleaning blade which occurs as the cleaning blade is vibrated by impact may allow the residual toner to slip through the nip N, although it may be possible to vibrate vigorously enough to remove the grown agglomeration of the residual toner.

However, with the prior art described above it is necessary to impart sufficient vibration to the cleaning blade in order to sufficiently remove the residual toner adjacent the edge of the cleaning blade, and the following problems arise.

Referring to FIG. 9, when a strong vibration is imparted to the cleaning blade 61, the residual toner coagulated at the edge 61*a* moves, due to the vibration, to a station 61*b* beyond the nip N, that is onto the cleaning blade 61 downstream of the nip N with respect to the moving direction of the surface of the photosensitive drum 11.

In the first image forming process after the vibration imparting step, the toner at the position 61*b* beyond the nip N of the cleaning blade 61, jumps at the electrostatic latent image on the photosensitive drum 11 after passing through the edge 61*a* of the cleaning blade 61, that is, the remaining latent image on the photosensitive drum 11 after the transfer of the toner image. With the result of an image defect in the image after one rotation of the photosensitive drum 11.

The inventors investigations have revealed the mechanism of the occurrence of the image defect attributable to the vibration imparted to the cleaning blade 61.

The toner deposited on the downstream portion 61*b* of the edge of the cleaning blade 61, keeps retaining the electric charge given by the developing means during the developing operation. Therefore, depending on the intensity of the electric field formed by the potential of the photosensitive drum 11 passing by the cleaning blade 61, the toner deposited on the downstream portion 61 of the edge is capable of jumping at the photosensitive drum 11.

An electric field formed between the developer carrying member and the photosensitive drum 11 which are electroconductors close to each other, as exists in the developing zone of the developing means, is very strong. However, there is no electrode closely opposed to the photosensitive drum 11 at the downstream portion 61*b* of the edge of cleaning blade 61, and therefore, even if the surface potential of the photosensitive drum 11 is the image dark portion potential, the charge which is strong and causes the toner to jump does not exist.

However, in the case of an electrostatic latent image, such as a linear image, for example, which has a bottom of potential at which the potential abruptly changes, a closed electric field is produced locally at the bottom of the potential with the result that toner deposited on the downstream portion 61*b* of the edge of the cleaning blade 61 is caused to jump at the photosensitive drum 11 by the closed electric field.

In this manner, the toner deposited on the downstream portion 61*b* of the edge of the cleaning blade 61 due to the vibration imparted to the cleaning blade 61, jumps at the portion having the intense closed electric field such as the edge portion of a line image which may be included in the electrostatic latent image formed on the photosensitive drum 11 in the next image forming operation. It is transferred onto the transfer material together with the image after one rotation of the photosensitive drum 11. This produces a defect in the image.

SUMMARY OF THE INVENTION

Accordingly, it is a principal object of the present invention to provide an image forming apparatus in which a cleaning power of the cleaning member is maintained stably, and the possible problem arising from the vibration imparted to the cleaning member.

According to the present invention, there is provided an image forming apparatus comprising an image bearing member; driving means for driving said image bearing member; latent image forming means for forming an electrostatic latent image on said image bearing member; developing means for developing the electrostatic latent image on said image bearing member with a developer; a cleaning member, contacted to said image bearing member, for cleaning a surface of said image bearing member; vibration imparting means for vibrating said cleaning member; control means for causing said latent image forming means to form an electrostatic latent image pattern for electrostatically attracting the developer deposited on said cleaning member and for causing said driving means to move the electrostatic latent image pattern to a contact portion where said cleaning member is contacted to said image bearing member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Figure 1:
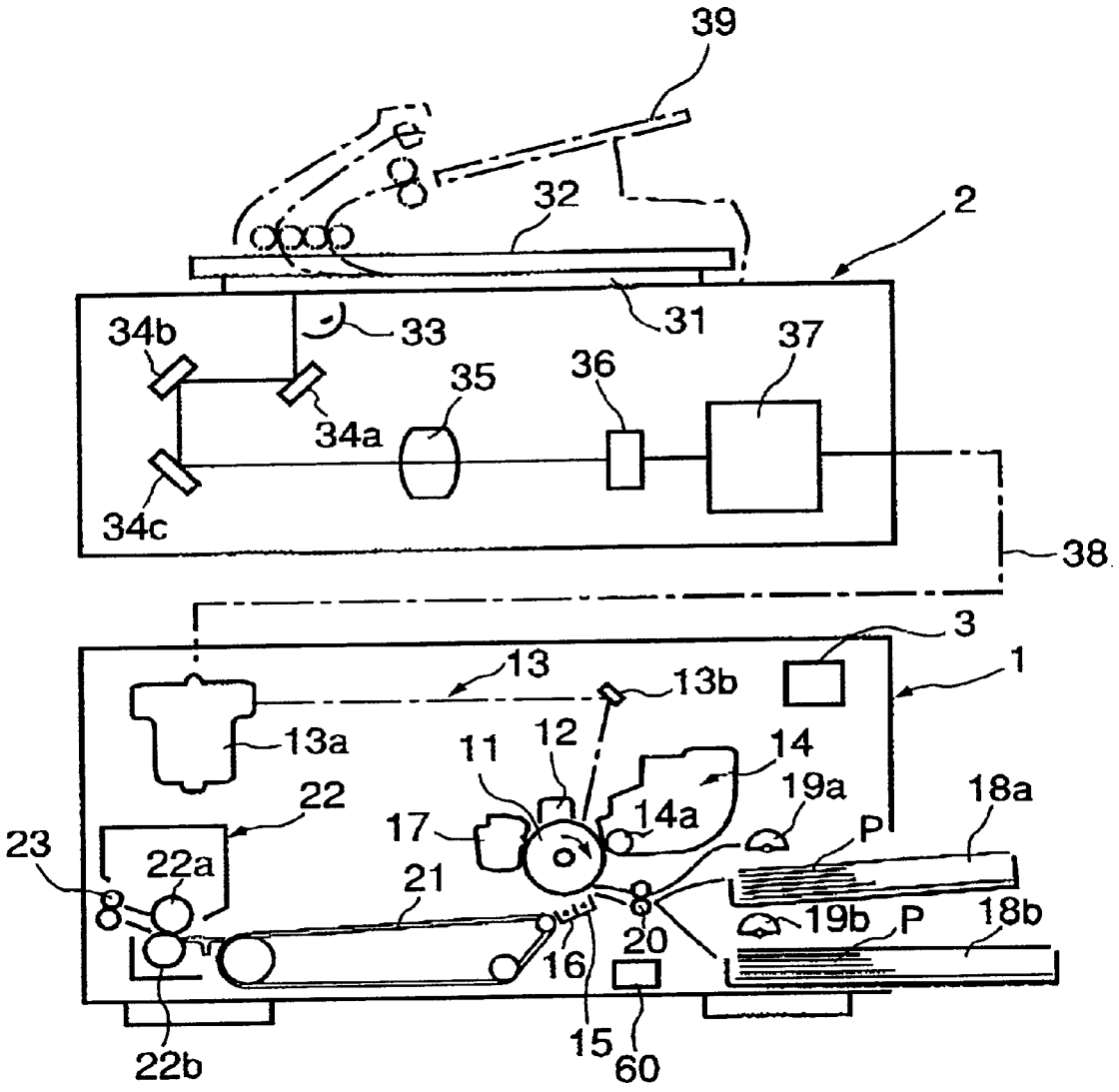
FIG. 1 is a sectional view of an image forming apparatus in accordance with the present invention, showing the general structure thereof.

Hereinafter, the preferred embodiments of the present invention will be described in conjunction with the appended drawings. In these drawings, those having the same reference numerals are the same in structure or operation, and their descriptions will be discretionarily omitted to eliminate repetition.

Embodiment 1

FIG. 1 shows an example of an image forming apparatus in accordance with the present invention. The image forming apparatus shown in the drawing is a laser beam printer. The image forming apparatus of FIG. 1 comprises a printer portion (image forming station) 1 and a reader portion (image reading station) 2.

The printing portion 1 comprises an electrophotographic photoconductive member 11, as an image bearing member, in the form of a drum (which hereinafter will be referred to as a photoconductive drum), which is disposed within the printing portion 1. The printing portion 1 also comprises a primary charging device 12 (primary charging means), an exposing apparatus 13 (exposing means), a developing device 14 (developing means), a transfer charging device 15, a separation charging device 16, and a cleaning apparatus 17 (cleaning means), which are disposed around the photoconductive drum 11 in the listed order in terms of the rotational direction (direction indicated by an arrow mark) of the photoconductive drum 11. There are also sheet feeding cassettes 18*a* and 18*b*, sheet feeding rollers 19*a* and 19*b*, a registration roller 20, a conveyer belt 21, a fixing device 22 (fixing means) having a fixing roller 22*a* and pressing roller 22*b*, and a pair of discharging rollers 23, which are disposed in the listed order in terms of the direction in which a transfer medium P (recording paper, OHP sheet, for example) is conveyed.

In comparison, the reader portion 2 comprises a platen glass 31, an original pressing plate 32, a light source 33, deflective mirrors 34*a*, 34*b*, and 34*c*, a lens 35, a CCD 36 (photoelectric transducer), an image processing portion 37, and the like.

Figure 6:
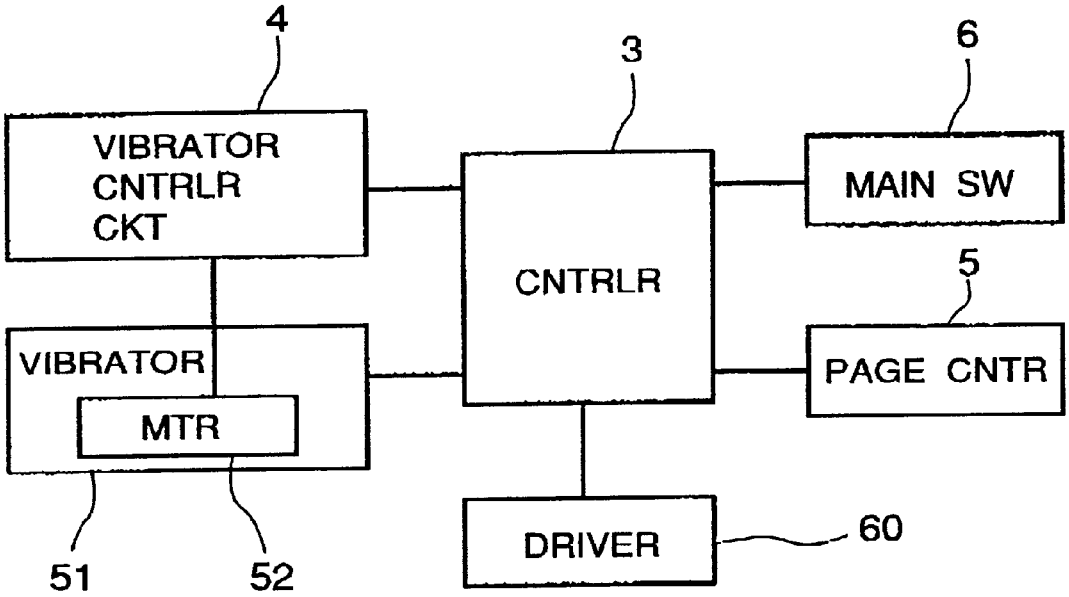
FIG. 6 is a block diagram of a control of the vibration generating means.

The operation of the image forming apparatus having such a structure will now be described. In the printer portion 1 of the image forming apparatus structured as described above, the photoconductive 25 drum 11 is rotationally driven by a driving means (unshown) in the direction indicated by an arrow mark at a predetermined process speed (peripheral velocity), which in this embodiment is 480 mm/sec, and the peripheral surface of the photoconductive drum 11 is uniformly charged to predetermined polarity and potential level by the primary charging device 12. Driving means 60 includes a motor and a gear for transmitting a driving force. The driving means 60 is controlled by control means 3, as shown in FIG. 6.

Meanwhile, in the reading portion 2, the image bearing surface (bottom surface) of an original (unshown) kept pressed upon the platen glass 31 by the original pressing plate 32 is illuminated by the light from the light source 33, reflecting the light. The light reflected by the image bearing surface is deflected by the deflective mirrors 34*a*, 34*b*, and 34*c*, is and is projected onto the CCD 36 by the lens 35, being transduced into electrical signals 38. The thus generated electrical signals 38 are subjected to various known image formation processes by the image processing portion 37, and then, are inputted, as image formation data, into the exposing apparatus 13 of the printer portion 1.

The laser scanner 13*a* of the exposing apparatus 13 projects a beam of laser light while modulating it with the aforementioned image formation data. Then, the beam of laser light is deflected by the deflective mirror 13*b,* and exposes the peripheral surface of the photoconductive drum 11, which has been charged uniformly. Through this exposure, an electrostatic latent image is formed on the peripheral surface of the photoconductive drum 11. Thus, the exposure means 13 functions as electrostatic latent image forming means for forming an electrostatic latent image by exposing the photosensitive drum 11 to image light.

The electrostatic latent image is developed by the developing device 14. More specifically, the developing device 14 contains developer (toner). The toner is carried on a developing sleeve 14*a* (developer carrying member) to a developing zone where the developing sleeve is opposed to the photosensitive drum 11. As development bias is applied to the development sleeve 14*a* of the developing device 14, the toner is electrostatically adhered to the peripheral surface of the photoconductive drum 11 in a pattern reflecting the electrostatic latent image; the electrostatic latent image is developed into a toner image.

The recording material P is fed out of a sheet cassette 18*a* or a sheet cassette 18*b* by a pick-up roller 19*a* or a pick-up roller 19*b,* and is fed in timed relation with the toner image on the photosensitive drum 11 with the aid of registration rollers 20 to an image transfer position which is formed between the photosensitive drum 11 and a transfer charger 15.

The toner image thus formed on the photosensitive drum 11 is transferred onto the recording material P by application of a transfer bias voltage to the transfer charger 15.

After the transfer of the toner image, the transfer medium P is separated from the peripheral surface of the photoconductive drum 11 by the separation charging device 16, and is conveyed by the conveyer belt 21 to the fixing device 22, in which the toner image is fixed to the surface of the transfer medium P by the heat and pressure applied by the fixing roller 22*a* and pressing roller 22*b*. Thereafter, the transfer medium P is discharged from the image forming apparatus main assembly by the pair of discharger rollers 23.

Meanwhile, the residual toner particles (residue), that is, the toner particles which were not transferred onto the transfer medium P in the transfer station, and remained on the peripheral surface of the photoconductive drum 11, are removed by the cleaning apparatus 17 to prepare the peripheral surface of the photoconductive drum 11 for the following image formation. The cleaning apparatus 17 will be described later in detail.

Incidentally, FIG. 1 outlines, with the use of double-dot chain lines, an automatic original feeding apparatus 39, which is located above the original pressing plate 32 and is capable of automatically feeding a single or plurality of originals onto the platen glass 31 and automatically removing the single or plurality of originals from the platen glass 31.

Figure 2:
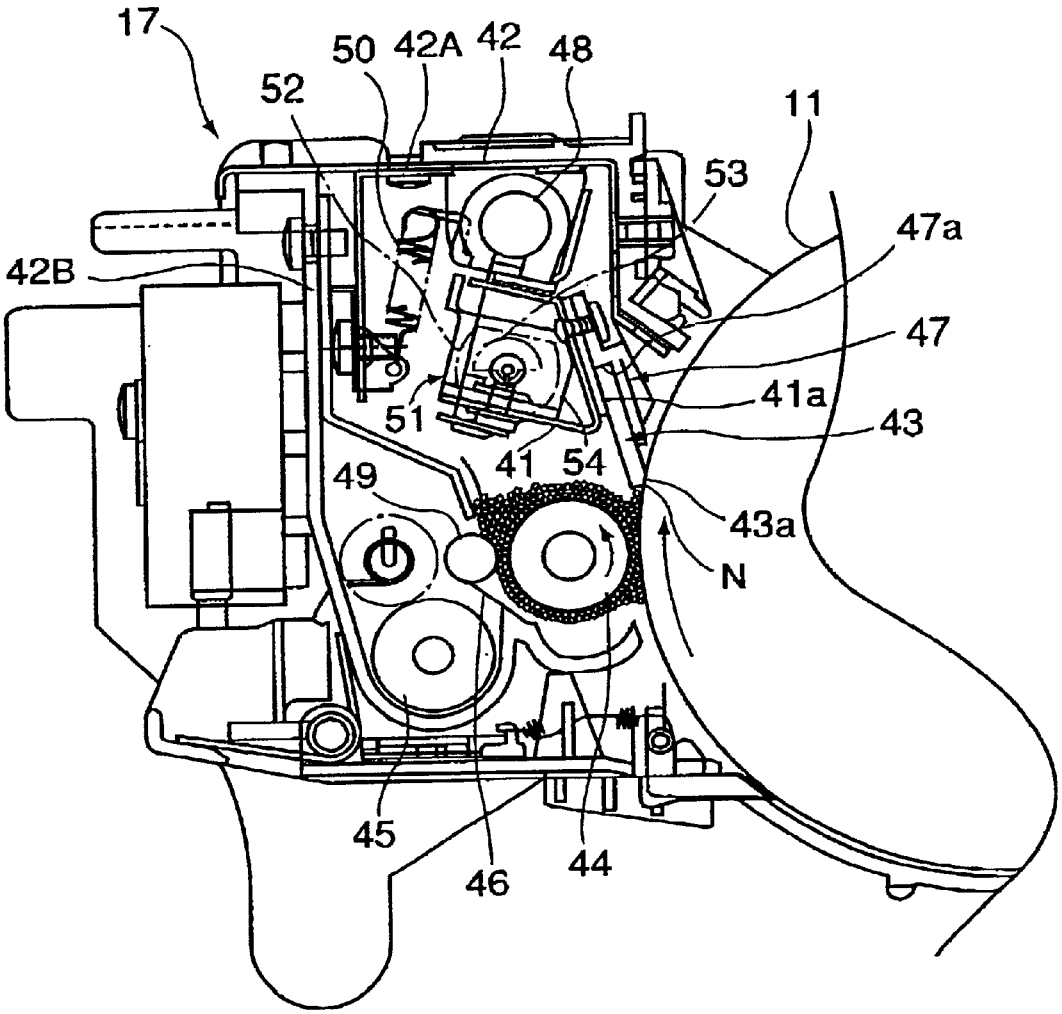
FIG. 2 is a sectional view of a cleaning apparatus used in the image forming apparatus shown in FIG. 1.

Next, referring to FIG. 2, the cleaning apparatus 17 in accordance with the present invention will be described in detail. FIG. 2 is a vertical sectional view of the cleaning apparatus 17, at a plane perpendicular to the lengthwise direction (axial direction) of the photoconductive drum 11.

The cleaning apparatus 17 comprises a first frame 41 (supporting member for the cleaning member), a second frame 42 (constituting a cleaning container), a cleaning blade 43 (cleaning member), a magnetic roller 44, a conveying screw 45 (residual toner transporting means), a sheet 46, a holder 47 (cleaning member supporting member), first and second shafts 48 and 49, a tension spring 50 (pressure applying means), and a vibration generating means 51.

The cleaning blade 43 is formed of an elastic plate. It is held to the first frame 41 by the holder 47, being sandwiched between the first frame 41 and the holder 47 screwed to the frame first 41. The cleaning blade 43 is placed in contact with the peripheral surface of the photoconductive drum 11 by the edge 43*a* (free end). The contact direction or the cleaning blade 43, or the angle at which the cleaning blade 43 is placed in contact with the peripheral surface of the photoconductive drum 11, is counter to the moving direction (direction indicated by arrow mark) of the peripheral surface of the photoconductive drum 11 (counterdirectional). The area 41*a* (contact surface) of the frame 41, with which the back surface of the cleaning blade 43 is placed in contact, and the area 47*a* (contact surface) of the holder 47, which is placed in contact with the cleaning blade 43 to keep the cleaning blade 43 held to the frame 41, are very precisely processed and very accurately positioned, making it possible for the cleaning blade 43 to be very accurately positioned relative to the photoconductive drum 11 as it is, held to the frame 41 by the holder 47, being partially placed in contact with the above described contact surfaces 41*a* and 47*a*. The frame 41, to which the cleaning blade 43 is held, holds the vibration generating means 51 as well.

The first frame 41 is attached to the second frame 42 with the use of the first shaft 48, being enabled to rotate about the shaft 48. In this embodiment, the frame 41 is movable in the lengthwise direction of the photoconductive drum 11. However, the cleaning apparatus may be structured so that the frame 41 is not movable in the lengthwise direction of the photoconductive drum 11.

One end of the tension spring 50 is connected to a part of the second frame 42, and the other end is attached to a part of the first frame 41. Thus, the first frame 41 is kept pressured by this tension spring 50 to rotate about the first shaft 48 in the counterclockwise direction of the drawing, generating thereby a predetermined amount of pressure between the edge 43*a* of the cleaning blade 43 and the peripheral surface of the photoconductive drum 11, while keeping the former in contact with the latter.

The second frame 42 is extended downwardly at a side remote from the photosensitive drum 11 and includes a bottom plate portion 42B extended toward the photosensitive drum 11. The aforementioned magnetic roller 44 and conveying screw 45 are rotationally held by the bottom plate portion 42B of the second frame 42. The magnetic roller 44 and conveying screw 45 are rotationally driven by a driving means (unshown).

The second frame 42 including the top plate portion 42A and the bottom plate portion 42B to constitute a cleaning container.

The magnetic roller 44 is disposed below the cleaning blade 43, bearing, on its peripheral surface, a layer of the residual toner particles having been scraped down from the peripheral surface of the photoconductive drum 11 by the cleaning blade 43. The thickness of this toner particles layer is regulated by the second shaft 49. The magnetic roller 44 is disposed in parallel with the lengthwise direction (axial direction) of the photoconductive drum 11, with the provision of a predetermined amount of gap between itself and the peripheral surface of the photoconductive drum 11, so that some of the residual toner particles in the residual toner particles layer on the magnetic roller 44 are coated again on the peripheral surface of the photoconductive drum 11, after landing on the magnetic roller 44 as they are removed from the peripheral surface Or the photoconductive drum 11. This prevents the following problem which occurs when the residual toner particles are scraped down by the cleaning blade 43 without being coated again onto the photoconductive drum 11, that is, the problem that the difference in friction between the portion of the cleaning blade edge 43*a* in contact with the portion of the peripheral surface of the photoconductive drum 11 covered with the residual toner particles, and the portion of the cleaning blade edge 43 in contact with the portion of the peripheral surface of the photoconductive drum 11 free of the residual toner particles, causes the cleaning blade 43 to slightly vibrate (which is unnecessary). In other words, coating the peripheral surface of the photoconductive drum 11 with the removed residual toner particles, uniformly in terms of the lengthwise direction of the photoconductive drum 11, makes uniform the friction between the cleaning blade 43 and photoconductive drum 11, across the entire contact range, in terms of the lengthwise direction of the photoconductive drum 11, preventing thereby the occurrence of the slight vibration of the cleaning blade traceable to the above described frictional nonuniformity. As the removed residual toner particles are coated onto the peripheral surface of the photoconductive drum 11, they are immediately scraped down, and are recovered by the magnetic roller 44.

Referring to FIG. 2, the rotational direction of the magnetic roller 44 is desired to be the same as that of the photoconductive drum 11 (codirectional relative to the surface movement of the photosensitive drum 11). However, the same effects as the above described can be realized even if the rotational direction of the magnetic roller 44 is reverse to that of the photoconductive drum 11 (counterdirectional).

The sheet 46 is placed in contact with the second shaft 49, and is given the function of directing the excessive amount of the removed residual toner particles, that is, the portion unnecessary for the formation of the toner layer on the magnetic roller 44, toward the conveying screw 45, which conveys the excessive amount of the removed residual toner into an unshown recovered toner container.

Figure 4:
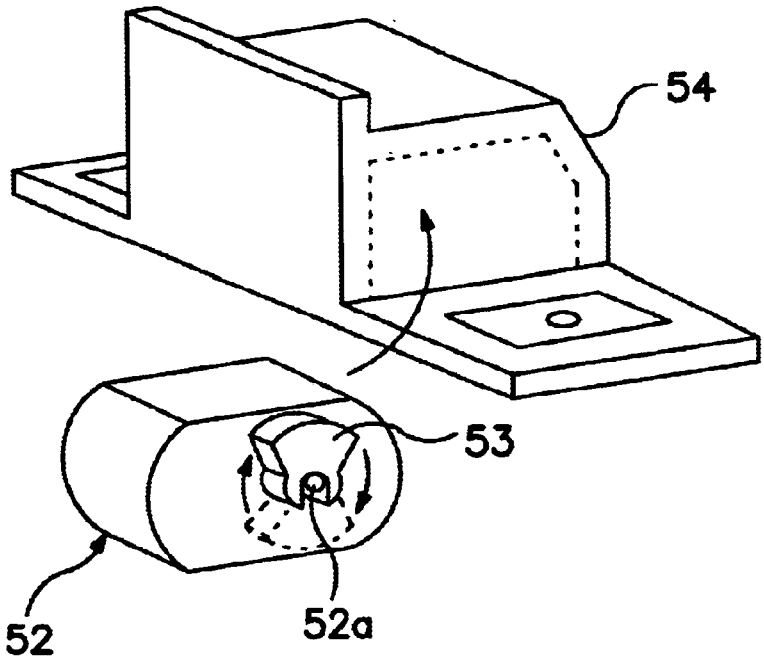
FIG. 4 is schematic view of a motor and a case, which makes up a vibration generating means.

FIG. 4 shows the structure of the vibration generating means 51 in this embodiment.

The vibration generating means 51 has a motor 52, a plummet S3 (weight) attached to the output shaft 52*a* of the motor 52, and a case 54. The motor 52 is securely encased in the case 54, being connected to a control circuit 55 as a controlling means, as shown in FIG. 6. The case 54, in which the motor 52 is secured, is solidly fixed to the first frame 41 as 15 shown in FIG. 2. The weight 53 is fixed to the output shaft 5Z*a* so that the center of gravity of the output shaft 52 becomes offset from the axial line of the output shaft 52*a*. Thus, as the output shaft 52*a* of the motor 52 is rotationally driven by the control circuit 55, the motor 52 generates vibration. The vibrations propagate through the case 54 and first frame 41, and reach the cleaning blade 43. The case 54 is given the function of preventing toner particles from entering the motor 52, and also the function of restraining the motor 52 allowing the vibrations to efficiently propagate to the first frame 41.

The structure of the vibration generating means 51 does not need to be limited to the above described one, as long as the cleaning blade 43 can be vibrated enough to remove the agglomeration of toner particles from the cleaning blade 43.

Figure 5:
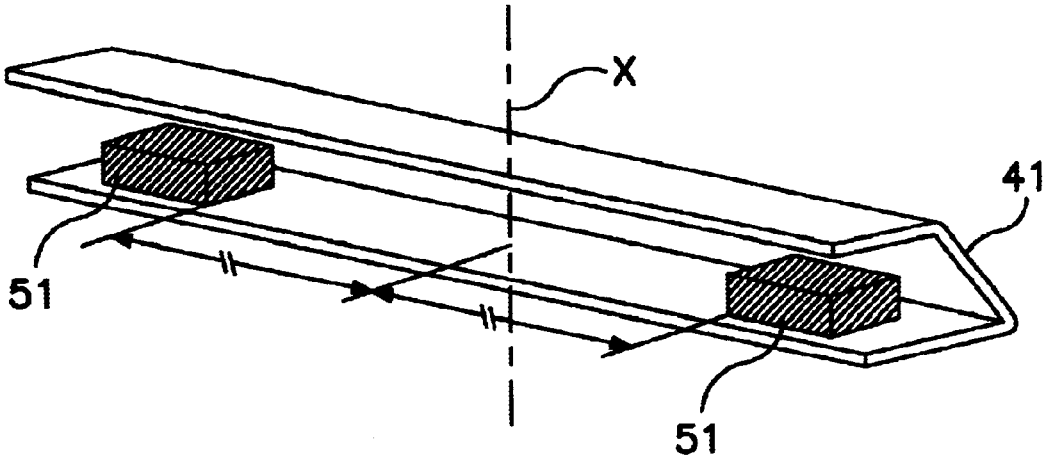
FIG. 5 is a perspective view of a combination of a frame and two vibration generating means attached to the frame.

As for the number and positioning of the vibration generating means 51, attaching a single vibration generating means 51 to the center of the first frame 41 of the cleaning apparatus 17, in terms of the lengthwise direction of the first frame 41, is effective to some extent. In the case of such a placement of the single vibration generating means 51, however, the vibrations must be relatively large in amplitude for them to propagate to the ends of the cleaning blade 43 to effectively remove the toner particle agglomeration. Thus, a plurality of vibration generating means 51 may be attached to the different portions of the first frame 41 so that vibrations can be evenly propagated throughout the cleaning blade 43 while keeping their amplitudes relative small. For example, the two vibration generating means 51 may be attached to the lengthwise end portions of the first frame 41 one for one as shown in FIG. 5. In this case, the plurality of vibration generating means 51 should be distributed toward the lengthwise end portions of the first frame 41 while balancing the two sides of the frame 41 with reference to the lengthwise center A of the first frame 41 (equidistant from point A), so that the unevenness in the contact pressure applied to the photoconductive drum 11 by the cleaning blade 43 is minimized.

In this embodiment, the vibration generating means 51 and the cleaning blade are separate members so that they can be exchanged individually. Because of this, the cost increase due to exchange of the cleaning blade 43 and the vibration generating means 51, and the operativity in the exchange is good.

Figure 3:
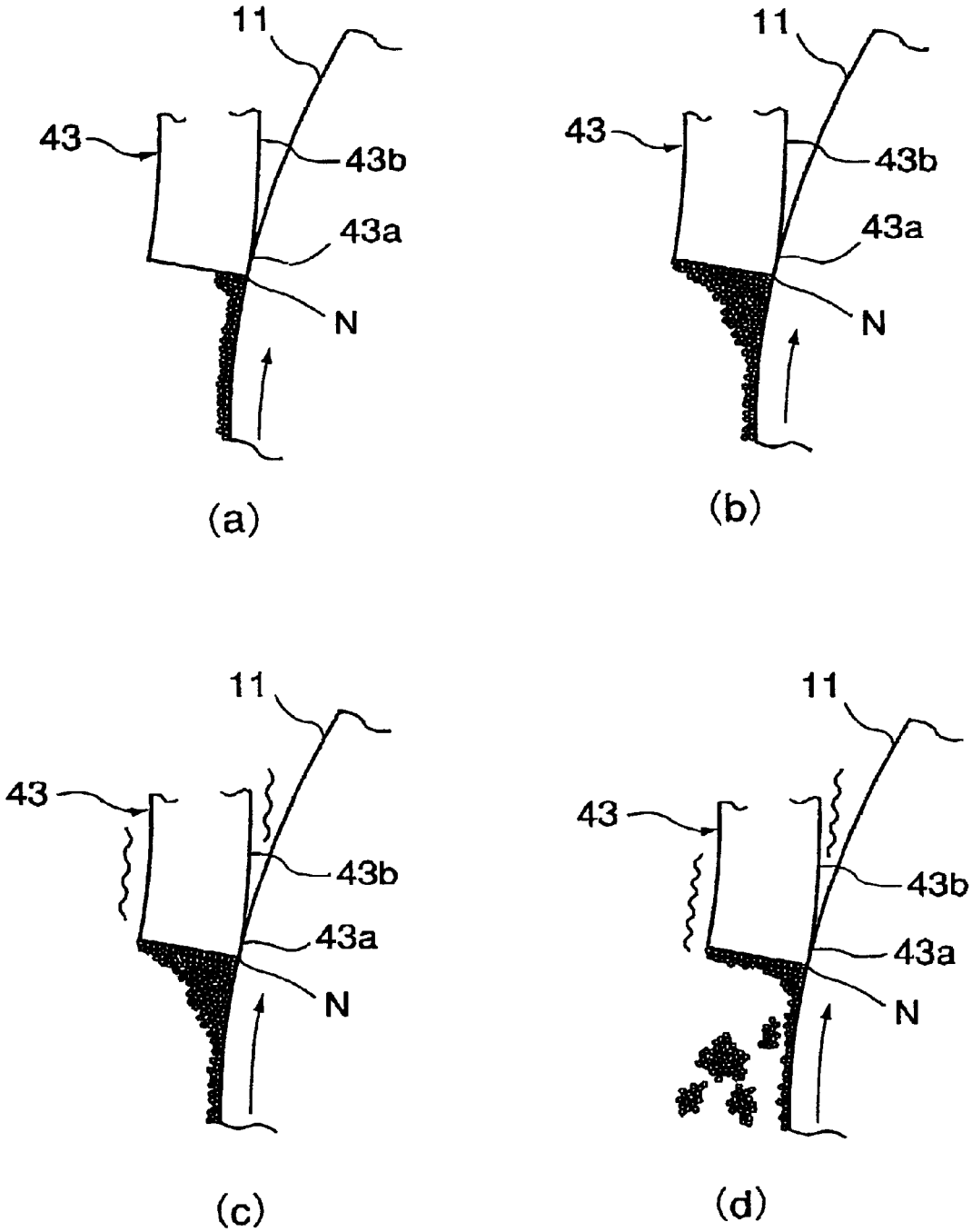
FIGS. 3(*a*), 3(*b*), 3(*c*), and 3(*d*) are enlarged schematic views of the edge of a cleaning blade and the peripheral surface of a photoconductive drum, showing how the toner particles having agglomerated in the adjacencies of the edge are removed by vibration.

FIGS. 3(*a*) through 3(*d*) are enlarged views of the contact portion N (nip) between the peripheral surface of the photoconductive drum 11 and the edge 43*a* of the cleaning blade 43, in this embodiment. Referring to FIG. 3(*a*), the edge 43*a* of the cleaning blade 43 in contact with the photoconductive drum 11 collects the residual toner particles it scrapes away from the peripheral surface of the photoconductive drum 11; the removed residual toner particles agglomerates at the edge 43*a*. Referring to FIG. 3(*b*), as the agglomeration of the removed residual toner particles grows, there rises a possibility that some of the residual toner particles will pass the nip N between the edge 43*a* of the cleaning blade 43 and the peripheral surface of the photoconductive drum 11 and adhere to the transfer medium P, resulting in the formation of a defective image. Therefore, the agglomeration of the removed residual toner particles desirably removed from the edge 43*a* of the cleaning blade 43 as it grows.

Thus, the vibration generating means 51 is activated to propagate vibrations to the cleaning blade 43 through the first frame 41 (FIG. 3(*c*)), so that the agglomeration of the removed residual toner particles is removed from the edge 43*a* of the cleaning blade 43 to prevent the formation of a defective image (FIG. 3(*d*)). As the vibration generating means 51 is activated, the vibrations therefrom also propagate to the photoconductive drum 11 through the cleaning blade 43. Therefore, the activation of the vibration generating means 51 is not desirable.

While an image is actually formed, if vibration generating means 51 is activated during the rotation of the photoconductive drum 11, the edge 43*a* of the cleaning blade 43 is partially separated from the photoconductive drum 11 by the vibrations, allowing sometimes the residual toner particles on the photoconductive drum 11 to pass the cleaning blade 43 and manifest as image defects. Therefore, the timing for the activation of the vibration generating means 51 is desired to be such that the vibration generating means 51 is activated only when t:he photoconductive drum 11 is completely still.

When an image forming apparatus stops at the end of an image forming operation, the photoconductive drum 11 continues to rotate for a while due to inertia before it comes to a complete stop. In other words, it takes a certain amount of time from the time when the signal for stopping the photoconductive drum 11 is produced to the time when the photoconductive drum 11 comes to a complete stop.

Figure 7:
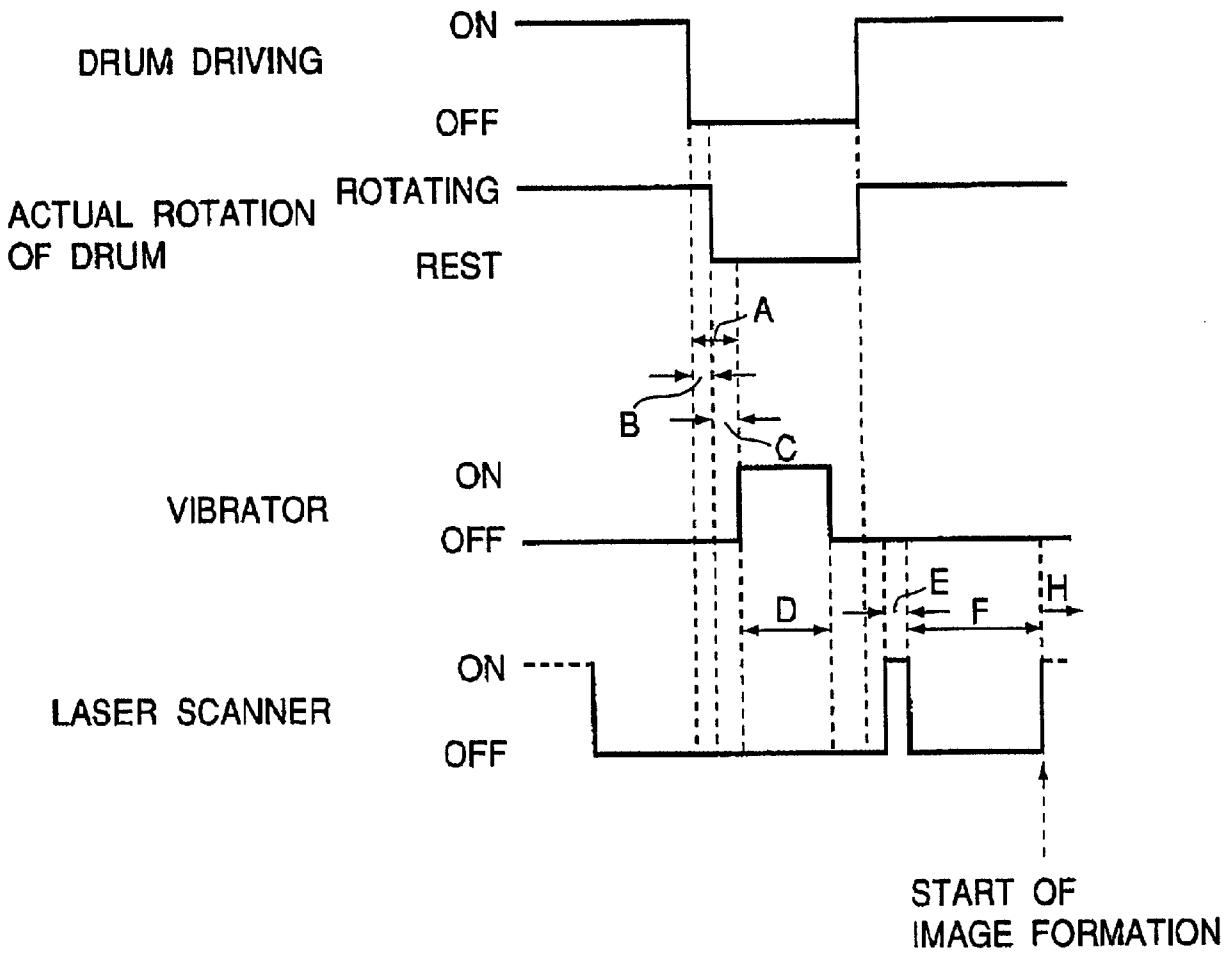
FIG. 7 is a chart of a operational sequence of the vibration generating means according to an embodiment of the present invention.

A description will be made as to the Liming of the vibration imparting action of the vibrating means 51 in this embodiment and the operation of the image forming apparatus after the impartment. FIG. 6 shows the control system for the vibration imparting means 51, and FIG. 7 shows an operational sequence of the vibration imparting means 51 in this embodiment.

As shown in FIG. 6, the image forming apparatus of this embodiment comprises a control device 3 for controlling the entire operation of the image forming apparatus, and a vibtrator control circuit 4 for controlling a rotation of the motor 52 for the vibration imparting means 51, and a page counter 5 for counting a number of image forming operations.

The count of the page counter 5 is reset by 25 the control device 3 upon actuation of a main switch 6 for actuation and deactuation of the entirety of the image forming apparatus. The page counter 5 counts the number of pages each time corresponding to an image forming operation for one recording material 1. When the count reaches 1000 pages, a signal indicative of the event is produced and supplied to the control device 3 from the page counter 5. Simultaneously, the page counter 5 is reset by the control device 5.

The control device 3 having received the count signal indicative of 1000 sheets, sequentially stops the reader portion 2, the primary charger 12, the laser scanner 13*a,* the developing device 14 and the like, and finally stops the rotation of the photosensitive drum 11.

The control means 3 supplies a motor start signal for initiating rotation of the motor 52 to the vibtrator control circuit 4 1 sec after (period A) generation of a stop signal for stopping the electric power supply to the motor (unshown) for driving the photosensitive drum 11, that is, the signal for stopping the photosensitive drum 11. In consideration of the inertia of the rotation system of the photosensitive drum 11, it is important that vibration imparting means 51 is vibrated not immediately after the stop signal for the photosensitive drum 11 but with a delay period A which is period B in which the photosensitive drum 11 continuing to rotate by the inertia completely stops which is predetermined on the basis of measurements, plus period C which is 0.1–0.5 sec.

The vibtrator control circuit 4 having received the motor start signal supplies electric power to the motor 52 for 1 sec (period D), to generate vibration in the vibration imparting means 51. By doing so, the vibration of the vibration imparting means 51 propagates to the cleaning blade 43 to cause the residual toner coagulated at the edge 43*a* to fall.

Then, the control device 3 sequentially resumes the rotation of the photosensitive drum 11, operations of the primary charger 12, the exposure device 13, the developing device 14 and the like. In this embodiment, prior to the formation of the electrostatic latent image corresponding to the image to be produced, that is, the image read by the reader portion 2 in this embodiment, a linear electrostatic latent image pattern having a width of 2 mm extending in parallel with a rotational axis of the photosensitive drum 11 is formed on the photosensitive drum 11 by one exposure operation (period E) of the laser scanner 13*a*. The length of the electrostatic latent image pattern measured in the direction or the axis of the photosensitive drum 11, is for example equivalent to the length of the nip N, or the full length of the image formation region of the photosensitive drum 11.

The electrostatic latent image pattern causes steep potential inclination (step) to form on the photosensitive drum 11. so that intense local closed electric field is formed. By this, the toner deposited on the downstream portion 43*b* of the edge of the cleaning blade 43 is caused to Jump at the photosensitive drum 11 in accordance with the electrostatic latent image pattern. As described hereinbefore, in the case that immediately after the cleaning blade 43 is vibrated by the vibration imparting means 51, a normal image forming operation is carried out, the toner deposited on the downstream portion 43*b* of the edge of the cleaning blade 43 due to the vibration imparting step, jumps at a linear electrostatic latent, image (remaining latent image after the transfer of the toner image), and the toner may be transferred onto the recording material P. This causes an image defect. In order to solve this problem, a dummy linear electrostatic latent image pattern is formed between the cleaning blade 43 vibrating step and the next image forming step.

The control device 3 starts (period H) the latent image forming operation for the normal image formation such as the image reading operation of the reader portion 2, the toner image formation on the photosensitive drum 11, the recording material P supplying operation, after the linear electrostatic latent image pattern passes through the cleaning station (nip N) twice (period F).

The linear electrostatic latent image pattern is passed through the cleaning station twice, since then the toner deposited on the photosensitive drum 11 from the downstream portion 43*b* of the edge of the cleaning blade 43 in the first rotation is removed by the cleaning station (nip N) during the second rotation. Therefore, the required number of rotations of the photosensitive drum 11 for the latent image pattern to pass through the cleaning station is not less than two.

Thereafter, after the count of the page counter 5 reaches 1000 again, the vibration is imparted to the cleaning blade 43 through the same sequence.

In this manner, the residual toner coagulated on the edge portion 43*a* of the cleaning blade 43 is shaked off for every 1000 image forming operations. And, the toner which moves to the on downstream portion 43*b* of the edge of the cleaning blade 43 due to the vibration is removed by a linear dummy electrostatic latent images pattern formed on the photosensitive drum t1 prior to the next image forming process. By doing so, proper cleaning operations are assured at all times, and the possible generation of the image defect resulting from the vibration or the cleaning blade 43 can be prevented.

As described in the foregoing, according to this embodiment, the residual toner stagnated and coagulated on the edge of the cleaning blade 43 is prevented from slipping through the cleaning blade 43 during the image forming operation, and simultaneously, the problem arising from the impartment of the vibration to the cleaning blade 43 can be prevented, with a simple structure and without cost increase.

Embodiment 2

A description will now be made as to a further embodiment. The fundamental structure of the image forming apparatus is similar to that of Embodiment 1. Therefore, the same reference numerals as with Embodiment 1 are assigned to the elements having the corresponding functions, and detailed description thereof is omitted for simplicity.

Figure 8:
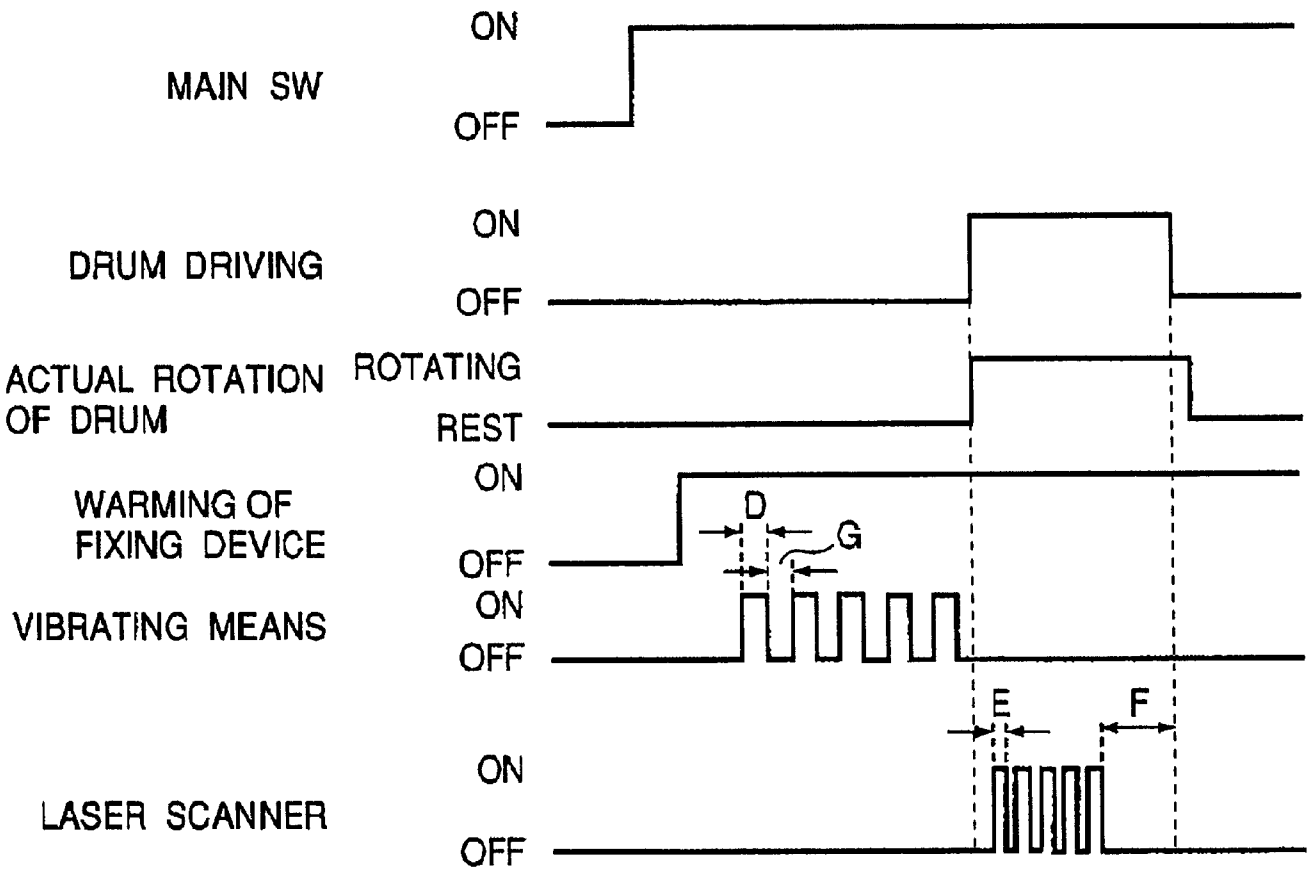
FIG. 8 is a chart of a operational sequence of the vibration generating means according to another embodiment of the present invention.
Figure 9:
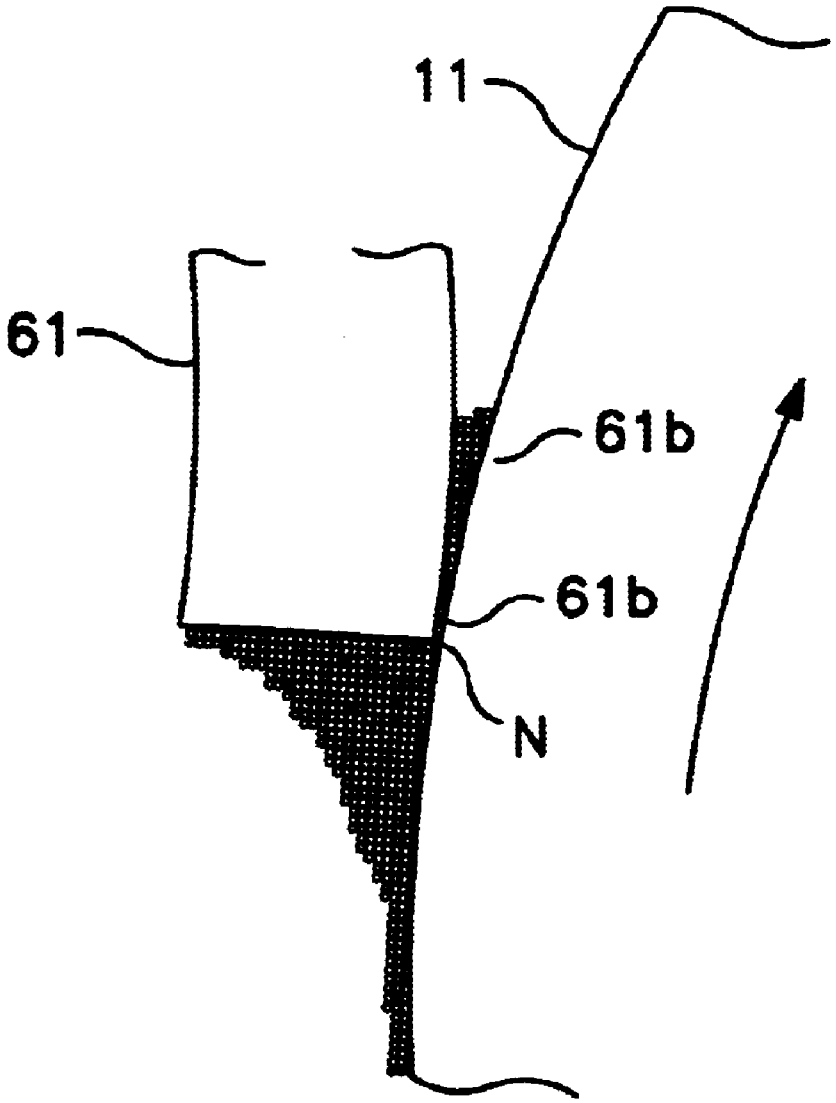
FIG. 9 Prior Art
FIG. 9 is an enlarged view of a neighborhood of a nip formed between a cleaning blade and a photosensitive drum, illustrating concentration of the toner particles to the neighborhood of the edge of the conventional cleaning blade.

In this embodiment, the vibration is imparted to the cleaning blade 43 prior to a first image forming operation after the main switch 6 of the image forming apparatus is actuated, in addition to the vibration imparting step of the cleaning blade 43 each time of 1000 image forming operations as in Embodiment 1. The main switch 6 is to supply the electric power to the main assembly of the apparatus. FIG. 8 shows an operational sequence of the vibration imparting means 51 ln this embodiment.

The residual toner coagulated at the edge portion 43*a* of the cleaning blade 43 becomes hardened with an elapse of long time in which the photosensitive drum 11 is at rest. Therefore, the residual toner coagulated in the image forming operation yesterday, is hardened during a midnight rest even to such an extent that coagulated residual toner is not sufficiently removed by one vibration for 1 sec imparted to the cleaning blade 43.

In this embodiment, at the time of actuation of the main switch 6 which can be considered as being an actuation after long non-operative state, the warming-up period for heating the fixing roller 22*a* of the fixing device 22 is used for the vibration impartment, more particularly, to supply the motor start signal (5 times) at 2 sec intervals to the vibrator control circuit 4 from the control device 3 at a predetermined timing. The predetermined timing may be any if the photosensitive drum 11 is not rotated. In this embodiment, the motor 52 is supplied with the electric power for 1 sec in response to one motor start signal. By doing so, the vibration imparting means 51 imparts the vibration for 1 sec (period D), five times, with 2 sec intervals (period G).

By repeating the vibration to the cleaning blade 43, the residual toner hardened during the midnight rest can be assuredly removed.

On the other hand, by the increase of the number of vibrations imparted to the cleaning blade 43, the amount or the toner moved to the downstream portion 43*b* of the nip of the cleaning blade 43 may increase. When a large amount of the toner is deposited to the downstream side of the nip N, one linear electrostatic latent image pattern (dummy pattern) might not be enough to remove all of the deposited toner.

In this embodiment, in the case that five vibrations are imparted to the cleaning blade 43 during the warming-up operation after the actuation of the main switch 6, the laser scanner 13*a* is rendered on and off five times (period E for each) after the control device 3 starts rotation of the photosensitive drum 11 and the operations of the primary charger 12, the exposure device 13, the developing device 14 and the like but during the warming-up operation after the vibration imparting step. By this, five linear electrostatic latent image patterns extending in the direction of the axis of the photosensitive drum 11 and having a width of 2 mm are formed.

Thereafter, the control device 3 stops the operations of the primary charger 12, the laser scanner 13*a,* the developing device 14 and the like after the fifth linear electrostatic latent image pattern passes through the cleaning station (nip N) twice. Then, it stops the rotation of the photosensitive drum 11 (period F). The second passing of the linear electrostatic latent image pattern through the nip N is awaited for the same reason as with Embodiment 1.

In order to prevent excessive elongation of the warming-up period, the initial motor start signal timing is determined in consideration of the fact that operation from the start of vibration by the vibration imparting means 51 to the linear electrostatic latent image pattern formation is completed during the warming-up period.

After such warming-up operation is completed, the image forming apparatus is in condition for start of image forming operation.

Similarly to Embodiment 1 for every 1000 image forming operations, the photosensitive drum 11 is stopped the combination of one vibration imparting action for the cleaning blade 43 and the one linear electrostatic latent image pattern formation is carried out.

The combination of the five vibration imparting actions and the five dummy electrostatic latent image pattern formations is not carried out for every 1000 image forming operations, in order to minimize the interruption period.

According to this embodiment, utilizing the warming-up time after the actuation of the main switch 6, the residual toner existing at the edge portion 43*a* of the cleaning blade 43 can be effectively removed, and in addition, the problem resulting from the impartment of the vibration can be assuredly prevented. During the image forming operation, the similar effects can be enjoyed with minimum time period.

As will be understood from the foregoing, in the durations between the vibration of the cleaning blade 43 and next image forming process, different electrostatic latent image patterns (different members of linear electrostatic latent images in this embodiment) are formed on the photosensitive drum 11, depending on the conditions of the vibrations imparted to the cleaning blade 43 by the vibration imparting means 51, more particularly, in accordance with the number of vibrations imported to the cleaning blade 43, in this embodiment. By doing so, the toner deposited on the downstream portion 43*b* of the edge of the cleaning blade 43 is effectively removed, depending on the amount of the toner.

As described in the foregoing, according to this embodiment of the present invention, the residual toner stagnated and coagulated on the edge of the cleaning blade 43 is effectively removed and prevented from slipping through the cleaning blade 43 during the image forming operation, even if the amount of the toner deposited on the edge of the cleaning blade 43 is large due to long term rest, with a simple structure and without cost increase. Simultaneously, the problem arising from the impartment of the vibration to the cleaning blade 43 can be prevented.

In addition, according to this embodiment, the toner deposited on the downstream portion 43*b* of the edge of the cleaning blade 43 can be assuredly removed, by different linear electrostatic latent image pattern (different in the number of electrostatic latent image patterns) between the vibration imparting step and the image forming step in accordance with the conditions of the vibration imparted to the cleaning blade 43 by the vibration imparting means 51 (in accordance with the number of repetitions, for example).

The present invention is not limited to the detailed structures described in the embodiments.

The conditions of the vibrations of the vibrations imparting means may be changed in accordance with ambient temperature and/or humidity detected by ambience detecting means. Generally, the toner tends to coagulate more if the temperature is higher or if the humidity is lower. Therefore, the number of vibrations or the intensity of the vibration may be increased with increase of the temperature or with decreases of the humidity. By doing so, the toner coagulation can be more effectively prevented. The toner collecting latent images can be determined in accordance with the connotations of the variable vibration.

In each of the foregoing embodiments, one vibration of the vibration imparting means 51 lasts for 1 sec, and the number of vibrations is one (during image forming operation) or five (during warming-up operation. However, these are not limiting, and may be determined properly in accordance with the characteristics of the toner. the process speed (peripheral speed) of the image forming apparatus, the material of the cleaning blade.

The width of the linear electrostatic latent image pattern formed between the vibration of the cleaning blade 43 and the next image forming step is not limited to 2 mm. When the imparted vibration is weak, the linear electrostatic latent image pattern is not necessarily formed.

It is desirable that electrostatic latent image pattern involves a steep or stepwise potential change. Even when the width of the electrostatic latent image pattern measured in the direction of the movement of the surface of the photosensitive drum 11 is 100 mm or longer, the advantageous effects of the present invention are provided in the steep potential inclination or stepwise potential change.

In addition, the timing of the impartment of the vibration to the cleaning blade 43 during the image forming operation is not limited to each 1000 pages of the image formations, but may be properly determined by one skilled in the art.

For example, the vibration during the warming-up operation after actuation of the main switch 6, may be five times with 0.5 sec intervals, and the formation of the linear electrostatic latent image pattern ls three times with the width of 120 mm; one vibration for 0.5 sec for each 500 page image forming operations, without formation of the subsequent formation of the linear electrostatic latent image pattern.

While the invention has been described with reference to the structures disclosed herein, it is not confined to the details set forth and this application is intended to cover such modifications or changes as may come within the purpose of the improvements or the scope of the following claims.

What is claimed is:

1. An image forming apparatus comprising:

an image bearing member;

driving means for driving said image bearing member;

latent image forming means for forming an electrostatic latent image on said image bearing member;

developing means for developing the electrostatic latent image with a developer;

a cleaning member contacted to said image bearing member for cleaning a surface of said image bearing member;

vibration imparting means for vibrating said cleaning member; and control means for causing said latent image forming means to form an electrostatic pattern corresponding to the electrostatic latent image for electrostatically attracting the developer deposited on said cleaning member and for causing said driving means to move the electrostatic pattern to a contact portion where said cleaning member is contacted to said image bearing member.

2. An apparatus according to claim 1, wherein the electrostatic pattern is formed on said image bearing member by said latent image forming means, and the electrostatic pattern is moved to the contact portion by said driving means, after completion of a vibration imparting operation by said vibration imparting means.

3. An apparatus according to claim 2, wherein an image forming operation is carried out after the developer, which is electrostatically attracted to the electrostatic pattern, is moved to the contact portion and is removed.

4. An apparatus according to claim 2, wherein said vibration imparting means imparts vibrations when said image bearing member is at rest.

5. An apparatus according to claim 1, wherein the electrostatic pattern extends in a direction perpendicular to a moving direction of a surface of said image bearing member.

6. An apparatus according to claim 1, wherein a vibration condition of said vibration imparting means is variable, and said latent image forming means forms the electrostatic pattern, which varies, depending on the vibration condition.

7. An apparatus according to claim 6, wherein the vibration condition corresponds to a number of vibrations, and said latent image forming means forms the electrostatic latent image pattern, which varies, depending on the number of vibrations.

8. An apparatus according to claim 6, wherein a vibration condition of said vibration imparting means varies between a time when vibrations are imparted after actuation of a main switch of said image forming apparatus and before a start of an image forming operation and a time when vibrations are imparted for each of a predetermined number of image forming operations.

9. An apparatus according to claim 8, wherein a number of vibrations imparted after actuation of a main switch of said image forming apparatus and before a start of the image forming operation is larger than a number of vibrations imparted for each of a predetermined number of image forming operations, and said latent image forming means forms the electrostatic pattern, which varies, depending on the number of vibrations.

10. An apparatus according to claim 6, wherein the electrostatic pattern is a linear pattern extending in a direction perpendicular to a moving direction of a surface of said image bearing member, and said latent image forming means changes a number of electrostatic patterns in accordance with a vibration condition.

11. An apparatus according to claim 1, further comprising supporting means, movable toward and away from said image bearing member, for supporting said cleaning member, wherein said vibration imparting means is fixed to said supporting means.

12. An apparatus according to claim 11, wherein said vibration imparting means comprises a motor and an eccentric weight mounted on an output shaft of said motor.

* * * * *

UNITED STATES PATENT AND TRADEMARK OFFICE

CERTIFICATE OF CORRECTION

PATENT NO. : 6,636,719 B2
DATED : October 21, 2003
INVENTOR(S) : Tsuyoshi Kunishi et al.

It is certified that error appears in the above-identified patent and that said Letters Patent is hereby corrected as shown below:

Column 1,
Line 9, “facsimileing” should read -- facsimile --; and
Line 42, “In” should read -- in --.

Column 3,
Line 50, “is” should read -- is a --.

Column 4,
Line 45, “25” should be deleted.

Column 6,
Line 8, “frame first” should read -- first frame --;
Line 10, “or” should read -- of --; and
Line 23, “is,” should read -- is --.

Column 7,
Line 3, “Or” should read -- of --;
Line 23, “blade” should read -- blade 43 --;
Line 50, “as 15” should read -- as --; and
Line 51, “*5Za*” should read -- 52a --.

Column 8,
Line 43, “particles” should read -- particles is --; and
Line 64, “t:he” should read -- the --.

Column 9,
Line 5, “Lining” should read -- timing --;
Line 19, “25 the” should read -- the --; and
Line 65, “or” should read -- of --.

Column 10,
Line 1, “steep” should read -- a steep --;
Line 2, “11.” should read -- 11, --;
Line 3, “that” should read -- that an --;
Line 5, “Jump” should read -- jump --;
Line 13, “latent,” should read -- latent --;
Line 41, “to the on” should read -- to the --;
Line 43, “images” should read -- image --; and
Line 44, “t1” should read -- 11 --.

UNITED STATES PATENT AND TRADEMARK OFFICE

CERTIFICATE OF CORRECTION

PATENT NO. : 6,636,719 B2
DATED : October 21, 2003
INVENTOR(S) : Tsuyoshi Kunishi et al.

It is certified that error appears in the above-identified patent and that said Letters Patent is hereby corrected as shown below:

Column 11,
Line 31, “or” should read -- of --; and
Line 67, “stopped” should read -- stopped, --.

Column 12,
Line 40, “pattern” should read -- patterns --;
Line 63, “operation.” should read -- operation). --;
Line 65, “toner.” should read -- toner, --; and
Line 66, “apparatus,” should read -- apparatus, and --.

Signed and Sealed this

Fifteenth Day of June, 2004

JON W. DUDAS
*Acting Director of the United States Patent and Trademark Office*